United States Patent [19]

Mathis

[11] Patent Number: 4,884,545

[45] Date of Patent: Dec. 5, 1989

[54] FUEL INJECTION SYSTEM FOR AN INTERNAL COMBUSTION ENGINE

[75] Inventor: Christian Mathis, Arbon, Switzerland

[73] Assignees: Iveco Fiat S.p.A., Turin, Italy; Dereco Dieselmotoren Forschungs-und Entwick-lungs-AG, Arbon, Switzerland

[21] Appl. No.: 215,607

[22] Filed: Jul. 6, 1988

[30] Foreign Application Priority Data

Jul. 8, 1987 [CH] Switzerland ..... 02598/87

[51] Int. Cl.[4] ..... F02M 39/00

[52] U.S. Cl. ..... 123/447; 123/497; 123/446

[58] Field of Search ..... 123/446, 447, 497, 495; 417/253

[56] References Cited

U.S. PATENT DOCUMENTS

| | | | |
|---|---|---|---|
| 2,999,463 | 9/1961 | Cameron-Johnson | 417/253 |
| 3,967,598 | 7/1976 | Rachel | 123/497 |
| 4,198,948 | 4/1980 | Conrad | 123/495 |
| 4,205,648 | 6/1980 | Graham | 123/497 |
| 4,217,862 | 8/1980 | Fort | 123/497 |
| 4,541,385 | 9/1985 | Eheim | 123/446 |
| 4,625,694 | 12/1986 | Adey | 417/253 |
| 4,674,448 | 6/1987 | Steiger | 123/446 |
| 4,719,889 | 1/1988 | Amann | 123/447 |

*Primary Examiner*—Carl Stuart Miller

*Attorney, Agent, or Firm*—Albert L. Jeffers; John F. Hoffman

[57] ABSTRACT

A high-pressure, continuous-delivery piston pump, controlled as a function of engine speed and load, supplies fuel to an accumulator supplying injectors. On the intake side of the pump, there is provided a throttle for metering the amount of fuel supplied by the pump. Via operating signals, the throttle is regulated by an electronic control device in such a manner as to supply the pump and pressurize only the amount of fuel strictly required for operating the injectors and the engine, thus eliminating any energy losses caused by fuel feedback to the tank, and drastically reducing fuel consumption.

8 Claims, 4 Drawing Sheets

FUEL INJECTION SYSTEM FOR AN INTERNAL COMBUSTION ENGINE

BACKGROUND OF THE INVENTION

The present invention relates to a fuel injection system as claimed in claim 1. p On known injection systems of this type, as per patent applications DE-OS 32 27 742 and EP-OS 0 149 598, the pressure accumulator is permanently connected to a duct on each injector via an annular compartment and throttle valve. Each injector presents an injection electrovalve for connecting the said duct to a fuel feedback pipe, thus releasing a pin on the injector closing the injection opening, and enabling fuel supply from a pressure compartment directly upstream from the injection opening. Fuel is supplied to the accumulator at a given pressure by means of a high-pressure hydraulic pump powered by the drive shaft via a gear, and the size of which depends on minimum required pressure at low engine speed, maximum fuel injection, and minimum pressure regulating speed. The disadvantage of such a system from the manufacturing standpoint is that pump design must conform with the requirements of different power engines, if optimum engine performance in terms of consumption and output is to be assured. This therefore amounts to manufacturing and storing a different pump for each type of engine, which inevitably results in increased manufacturing costs.

A further drawback of known systems of the aforementioned type is that, being constant and designed to cater to maximum requirements, fuel supply by the high-pressure pump is invariably in excess of actual consumption, so that a large percentage of the fuel supplied by the pump must be fed back to the tank via a pressure regulator, the energy loss of which increases overall consumption or at least affects output of the engine.

Yet a further drawback of known systems is that overheating of the fuel at the bottom of the tank often entails assembling an intercooler, which, in addition to further increasing manufacturing cost, may also increase fuel consumption.

SUMMARY OF THE INVENTION

The aim of the present invention is to provide a fuel injection system as claimed in claim 1, designed to overcome the aforementioned drawbacks associated with known systems, i.e. storing a large number of different pump sizes for the high-pressure system of different types of engines; and excess fuel supply and consumption under normal operating conditions.

The above drawbacks are overcome by the system as claimed in claim 1.

Under all operating conditions, and with no change in pump speed, the system according to the present invention provides for supplying and pressurizing only the exact amount of fuel required for combustion and operation of the injectors, thus reducing operating power, as compared with known systems featuring constant-delivery pumps, under partial-load conditions requiring reduced fuel pressurization. Eliminating fuel feedback to the tank provides for approximately 4% fuel saving at maximum power, and even more under normal partial-load conditions, as compared with known systems. By virtue of the pressure in the accumulator depending, not on the size of the pump, but on the throttle valve setting regulating the opening on the intake pipe and, therefore, the amount of fuel supplied to the pump, a limited number of pumps are sufficient for catering to a wide range of different engines. The injection system according to the present invention also responds rapidly to control. For example, when the throttle valve is opened fully, the pressure in the accumulator increases rapidly, which is of enormous advantage, particularly when accelerating. The system according to the present invention also provides for simplifying design and so reducing manufacturing cost. For example, the pressure regulator required on the fuel feedback pipe of known systems may be dispensed with entirely, or at least simplified, for example, in the form of a straightforward safety valve.

Variable-delivery hydraulic pumps are currently employed for numerous applications, but are usually swash-plate types unsuitable for low-viscosity fluids, not to mention the high pressures involved in the present application. Claims 2 to 8 relate to further embodiments of the system according to the present invention.

BRIEF DESCRIPTION OF THE DRAWINGS

The present invention will be described in detail with reference to the accompanying drawings, in which.

DETAILED DESCRIPTION OF THE INVENTION

Figure 1:
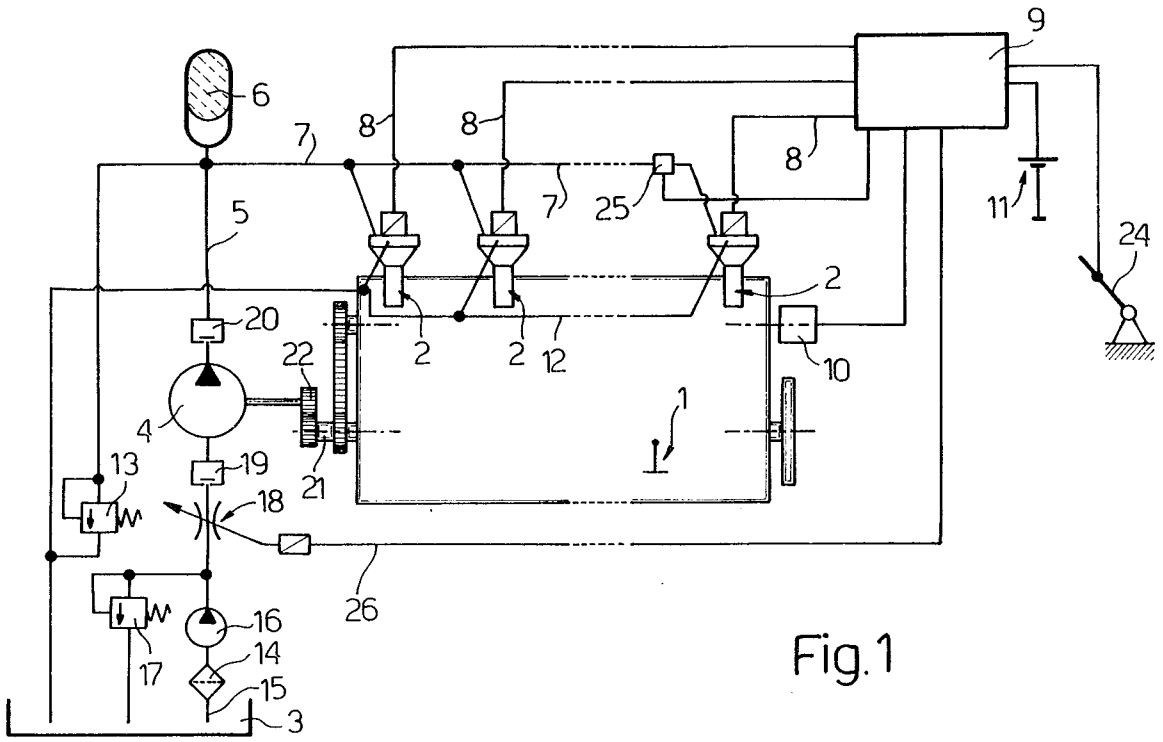
FIG. 1 shows a diagram of a fuel injection system for a high-speed multiple cylinder Diesel engine.

Number 1 in FIG. 1 indicates a multiple cylinder Diesel engine, on which the injectors 2 (three in the example shown) are supplied from a tank 3. By means of a high-pressure piston pump 4, fuel is fed along pipe 5 to an accumulator 6 and along delivery pipe 7 to injectors 2. Via electric wires 8, each injector 2 is controlled by an electronic control device 9 supplied by battery 11, and which generates an injection signal, the form and length of which depend on the signals of a position and speed transducer 10 and other data. A fuel feedback pipe 12 runs from injectors 2 back to tank 3. Between pressure pipe 5 and fuel feedback pipe 12, provision is made for a straightforward safety valve 13 which only opens at a pressure not encountered under normal operating conditions.

Under normal operating conditions, therefore, no fuel is fed back from injectors 2 to tank 3 via pipe 12 and valve 13—a fuel saving solution made possible by virtue of the design features described in more detail later on. The fuel in tank 3 is sucked up by pre-delivery pump 16 through intake pipe 15 and filter 14, and pressurized as determined by low-pressure valve 17. At this point, the intake stroke of the pump 4 piston forces it through throttle 18 and check valve 19, after which, the delivery stroke of the piston forces it through a further check valve 20 on pipe 5 into pressure accumulator 6. High-pressure pump 4 is powered by drive shaft 21 via gear 22, which regulates the required speed ratio between drive shaft 21 and shaft 23 of pump 4. Depending on the type of engine involved, a pressure value is selected on electronic control device 9 as a function of current speed, the position of accelerator 24 and other parameters, and compared with the actual pressure value as measured by a pressure sensor 25 on delivery pipe 7 to injectors 2. Any difference between the set and real values is adjusted by accordingly regulating throttle 18 via cable 26 connecting control device 9 to throttle 18 upstream from the pump.

By virtue of the above system, in particular, regulation of throttle 18 on the delivery pipe to pump 4, the present invention provides for ensuring that high-pressure pump 4 supplies and pressurizes only the exact amount of fuel required for operating the engine. Unlike known systems, injectors 2 are supplied exclusively with fuel at optimum injection pressure, with no need for pressurizing excess fuel, which must only be fed back into tank 3. A further advantage of eliminating fuel feedback by regulating fuel supply via a fast-response throttle upstream from pump 4 is that, in the event of a sharp change in the position of the accelerator pedal, as when overtaking, throttle 18 is opened fully for enabling immediate supply of the required amount of fuel by the pump. As this briefly exceeds consumption, the pressure in accumulator 6 also increases rapidly.

Figure 2:
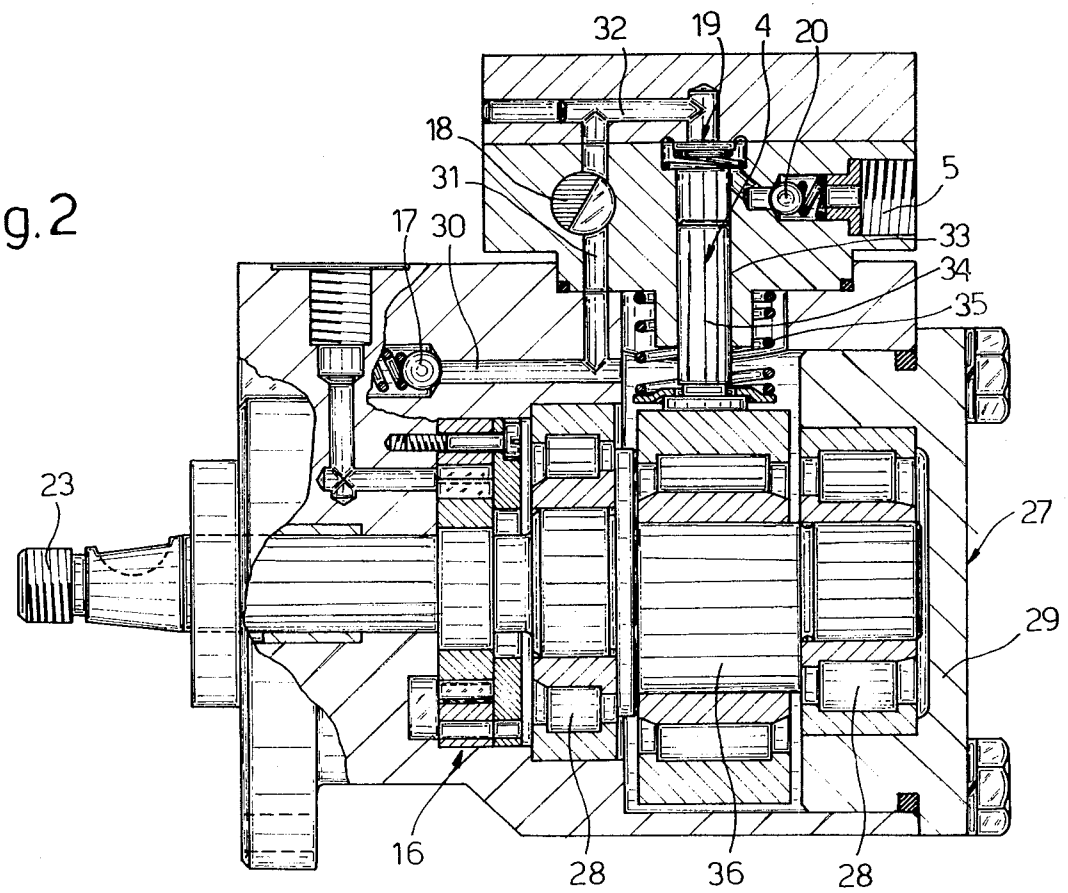
FIG. 2 shows a section of one embodiment of a fuel pump featuring, upstream on the intake side, a throttle valve and pre-delivery pump.

FIG. 2 shows a further embodiment wherein the high-pressure pump and the components up- and downstream from the same are assembled into a compact unit 27. In addition to the high-pressure piston pump, unit 27 also comprises the pre-delivery pump 16, as in FIG. 1, throttle 18 upstream from pump 4, the two check valves 19 and 20, and low-pressure valve 17.

Drive shaft 23 on bearings 28 inside housing 29 of unit 27 corresponds with pump shaft 23 in the FIG. 1 embodiment, and provides for powering pre-delivery pump 16 supplying fuel from the tank into duct 30 at the pressure determined by low-pressure valve 17. From duct 30, a further duct 31 feeds the fuel through throttle 18 (shown in the partially open position) and into intake duct 32 of high-pressure pump 4. The said pump 4 comprises a piston 34 sliding inside a cylinder 44, and which is pressed by a spring 35 against an eccentric disc 36 located on shaft 23 and which moves the piston up and down. At each downstroke of piston 34 (FIG. 2), the fuel in intake duct 32 is sucked through check valve 19 and, when the piston moves back up, is forced through check valve 20 and along pressure pipe 5 to accumulator 6.

Figure 3A:
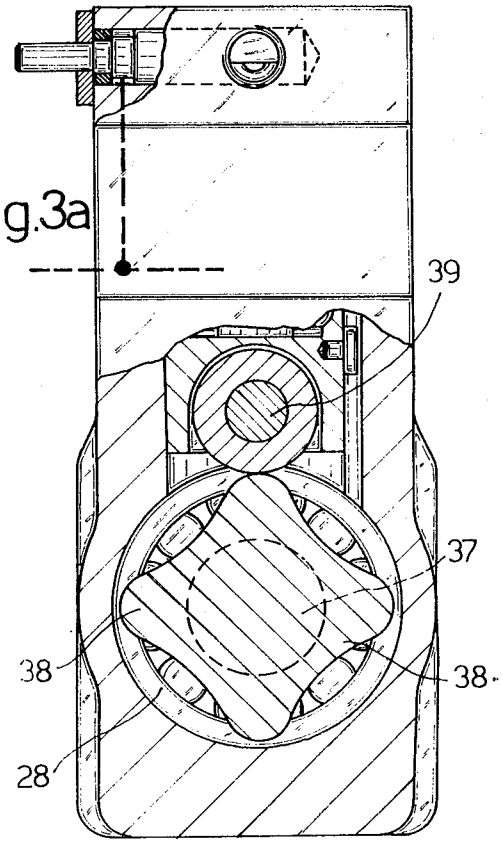
FIGS. 3 and 3*a* shown an axial and cross section respectively of a second embodiment of the said pump.
Figure 3:
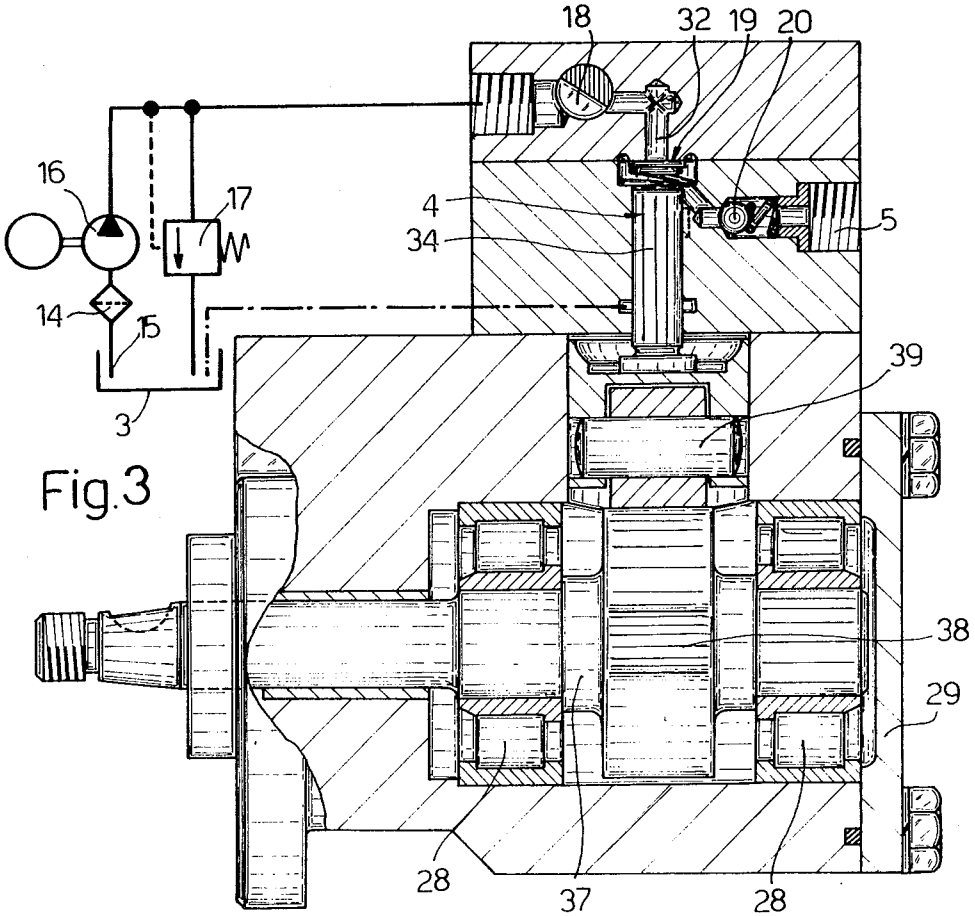

In the FIG. 2 embodiment, each turn of shaft 23 is accompanied by one stroke of piston 34 on pump 4, and the number of strokes per turn of drive shaft 21, depending on the number of cylinders on the engine, is determined by gear 22. In the FIGS. 3 and 3*a* embodiment, on the other hand, gear 22 and eccentric disc 36 (FIG. 2) are replaced by a pump shaft in the form of camshaft 37 having a number of cams 38 (four in the example shown) according to the number of cylinders on the engine.

A roller 39 traveling over cams 38 controls operation of a single piston 34. In this case, too, camshaft 37 rests on bearings 28 inside housing 29. Unlike the FIG. 2 embodiment, the FIGS. 3 and 3*a* embodiment presents an external pre-delivery pump 16 and low-pressure valve 17, and pre-delivery pump 16 is powered, for example, electrically. In the FIGS. 3 and 3*a* embodiment also, throttle 18 and the two check valves 19 and 20 are located at the inlet or outlet of pump 4 inside housing 29.

Figure 4:
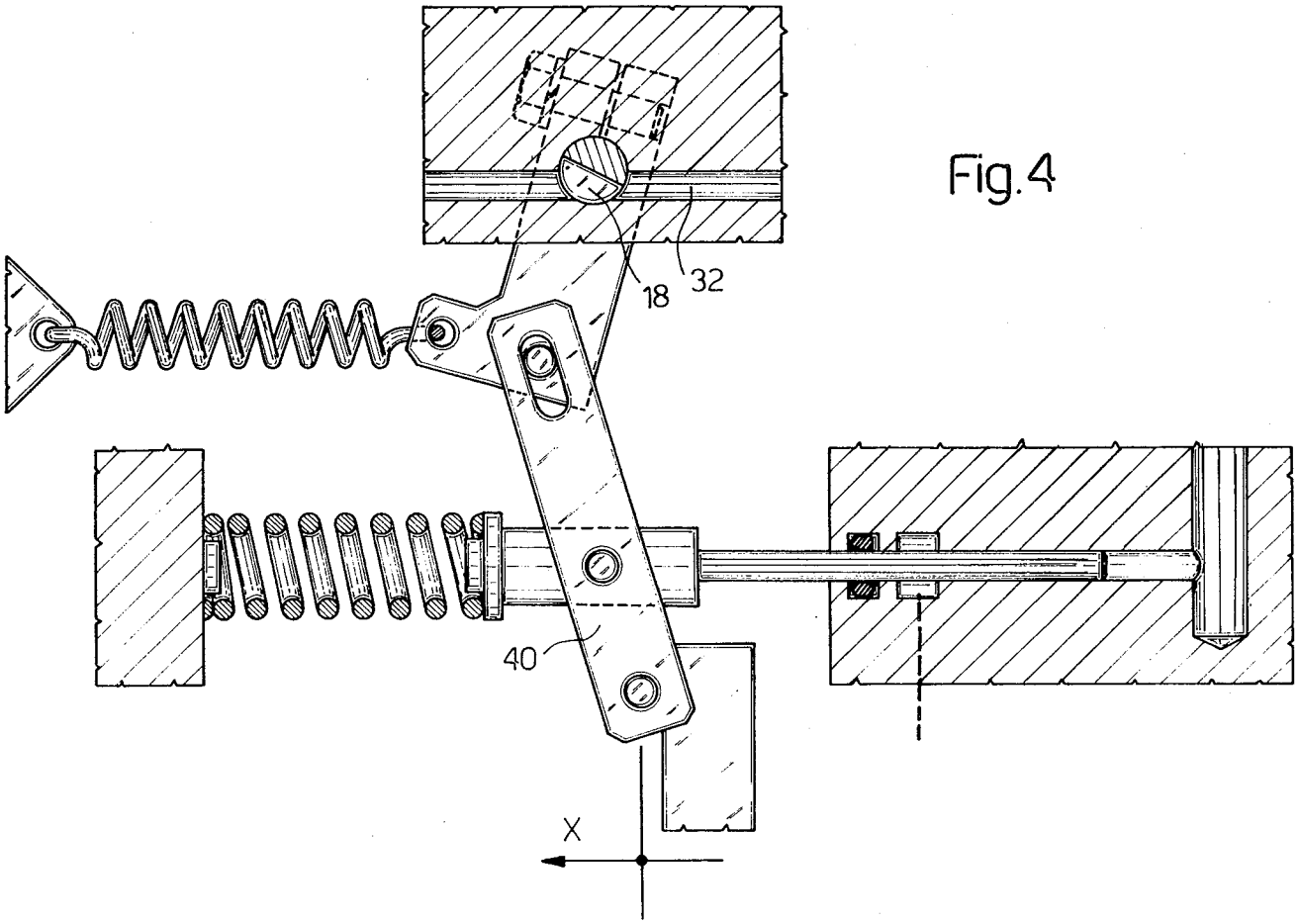
FIG. 4 shows a partially schematic view of a further embodiment featuring mechanical throttle adjustment, e.g. via the accelerator rods of a motor vehicle.

FIG. 4 shows a relatively straightforward embodiment wherein throttle 18 is regulated mechanically in the high-pressure pump intake pipe. In this case, the position of lever 40, adjustable in direction X, indicates the theoretical pressure value. As shown in FIG. 4, the said lever 40 provides for adjusting the aperture of throttle 18 mechanically, until the said theoretical pressure is attained in the accumulator.

The said lever is positioned by the electronic control device on the engine, but may also be controlled directly by the accelerator pedal. Such a variation would eliminate the characteristic pressure curve, in which case injectors 2 could be controlled as a function of pressure and speed by an electronic control device 9 decidedly less complex than in the foregoing examples.

What is claimed is:

1. A fuel injection system for an internal combustion engine, particularly a Diesel engine, comprising injectors for each cylinder controlled by an electronic control device, and, upstream from the said injectors, a fuel accumulator supplying said injectors and itself supplied by a continuous-delivery fuel pump controlled as a function of engine speed and load; characterised in that, on the intake side of said pump, there is provided a throttle means for metering the amount of fuel supplied by said pump; and that, via operating signals, said throttle means is regulated mechanically and/or by said electronic control device in such a manner as to supply the said pump with no more than the required amount of fuel.

2. A fuel injection system as claimed in claim 1, characterised in that said fuel pump is a high-pressure piston pump, which, together with the throttle of a pre-delivery pump operating on the same pump shaft, a low-pressure valve, and a check valve located on one side between said throttle and said pump, forms an enclosed unit housed inside a casing.

3. A fuel injection system as claimed in claim 2, characterised in that the piston of said pump is controlled by a cam on said pump shaft, controlled by the engine drive shaft via a gear.

4. A fuel injection system as claimed in claim 2, characterised in that the piston of said pump is controlled by the cams of a pump shaft in the form of a camshaft, on which the number of cams, and therefore the number of strokes of the said piston of said pump per turn of said shaft, depends on the number of injectors in the system.

5. A fuel injection system as claimed in claim 1, characterised in that said throttle is regulated mechanically via rods engaging directly with the same.

6. A fuel injection system as claimed in claim 1, characterised in that a pre-delivery pump and low-pressure valve are provided upstream from said throttle for bringing the fuel upstream from said throttle to a given pressure.

7. A fuel injection system as claimed in claim 6, characterised in that said pre-delivery pump is powered electrically.

8. A fuel injection system as claimed in claim 1, characterised in that a safety valve is provided in a fuel feedback line between said injectors and said tank, for opening said line exclusively in the presence of other than normal operating pressure.

* * * * *